US006626346B2

(12) United States Patent
Jairam et al.

(10) Patent No.: US 6,626,346 B2
(45) Date of Patent: Sep. 30, 2003

(54) JAM CLEARING MECHANISM FOR A STAPLER

(75) Inventors: Anthony Jairam, Sunrise, FL (US); Bikram Sohi, Wheeling, IL (US)

(73) Assignee: Acco Brands, Inc., Lincolnshire, IL (US)

( * ) Notice: Subject to any disclaimer, the term of this patent is extended or adjusted under 35 U.S.C. 154(b) by 0 days.

(21) Appl. No.: 10/079,346

(22) Filed: Feb. 20, 2002

(65) Prior Publication Data

US 2003/0155399 A1 Aug. 21, 2003

(51) Int. Cl.[7] ..... B25C 5/16

(52) U.S. Cl. ..... 227/127; 227/120; 227/132; 227/134

(58) Field of Search ..... 227/123, 125, 227/127, 128, 134, 122, 121, 132, 120

(56) References Cited

U.S. PATENT DOCUMENTS

| | | | | | |
|---|---|---|---|---|---|
| 3,840,165 | A | * | 10/1974 | Howard | 227/123 |
| 4,184,622 | A | * | 1/1980 | Spehrley, Jr. | 227/123 |
| 4,200,215 | A | * | 4/1980 | Novak et al. | 227/123 |
| 4,230,249 | A | * | 10/1980 | Nasiatka et al. | 227/134 |
| 5,364,000 | A | * | 11/1994 | Fealey | 227/134 |
| 6,179,193 | B1 | * | 1/2001 | Nagai | 227/127 |

* cited by examiner

*Primary Examiner*—Scott A. Smith
(74) *Attorney, Agent, or Firm*—Michael Best & Friedrich LLP

(57) ABSTRACT

A stapler comprising a base, and a cartridge assembly coupled to the base. The cartridge assembly includes a magazine having a magazine housing with a dispensing opening and a rail positioned in the magazine housing. The rail is movable relative to the housing between a static position toward the opening and a retracted position away from the opening. A rail retractor is adapted to engage the rail and move the rail from the static position to the retracted position to facilitate removal of a jammed staple.

14 Claims, 5 Drawing Sheets

10
12
14
16
18
20
22
24
26
28
30
32
34
36
38
40
42
44
46
47
48
50
52
54
56
58
60
62
64
66
68
70
72
74
76
78
80
82
84
86
88
90
92
94
6
7
8

JAM CLEARING MECHANISM FOR A STAPLER

FIELD OF THE INVENTION

The present invention relates to staplers, and more particularly to jam clearing mechanisms for staplers.

BACKGROUND OF THE INVENTION

Heavy duty staplers typically include a base, a cartridge assembly pivotally mounted to the base, and a lever assembly including a lever arm 16 that will provide a force to the cartridge assembly to drive a staple through a stack of sheets.

Cartridge assemblies commonly include a cartridge housing and a magazine positioned in the cartridge housing and designed to feed staples for the stapling process. The magazine typically includes a magazine housing and a rail positioned in the magazine housing to support a row of staples in preparation for the stapling process. The rail is commonly spaced from the front wall of the magazine housing to provide an exit space for a staple to be driven down through an opening in the magazine housing and into a stack of sheets.

For a variety of reasons, staplers sometimes become jammed. While there are many different modes of jamming, one common mode is for a misformed staple to become wedged in the exit space between the rail and the front wall of the magazine housing. This situation usually requires the user to turn the stapler over and remove the jammed staple by inserting a thin implement into the opening and prying the jammed staple out. It can be appreciated that it would be desirable to have a stapler that can remove jammed staples without the need to turn the stapler over and manually pry it out of the opening.

SUMMARY OF THE INVENTION

The present invention provides a stapler that facilitates removal of jammed staple by merely actuating a retractor that retracts the rail. This widens the exit space between the front edge of the rail and the front wall of the magazine housing, thus allowing the jammed staple to fall out of the magazine via gravity.

More specifically, the present invention provides a stapler comprising a base, and a cartridge assembly coupled to the base. The cartridge assembly includes a magazine having a magazine housing with a dispensing opening and a rail positioned in the magazine housing. The rail is movable relative to the housing between a static position toward the opening and a retracted position away from the opening. A rail retractor is adapted to engage the rail and move the rail from the static position to the retracted position to facilitate removal of a jammed staple.

In one embodiment, the retractor is designed to engage a tab on the rail. In order to allow the magazine to be removed from the cartridge housing for loading staples, the retractor is preferably designed so that it will not interfere with the longitudinal movement of the magazine (including the tab on the rail). For example, the retractor can be designed so that in an engaged position the retractor engages the tab and is at least partially aligned with the tab in a direction parallel to the longitudinal axis, and in a disengaged position the retractor is disengaged with the tab and is not aligned with the tab to facilitate movement of the magazine out of the housing for staple loading.

The retractor can be embodied in many different designs. In one embodiment, the retractor is rotatable and includes a handle, a rotatable shaft coupled to the handle, and an actuator coupled to the shaft. The handle is easily accessible by the user without the need to turn the stapler over.

The present invention is also embodied in a method of removing a staple jammed in a stapler. The method includes increasing the exit space between the rail and the front wall of the magazine housing. This method can be readily performed using the apparatus (e.g., retractor) described above.

Other features and advantages of the invention will become apparent to those skilled in the art upon review of the following detailed description, claims, and drawings.

Figure 1:
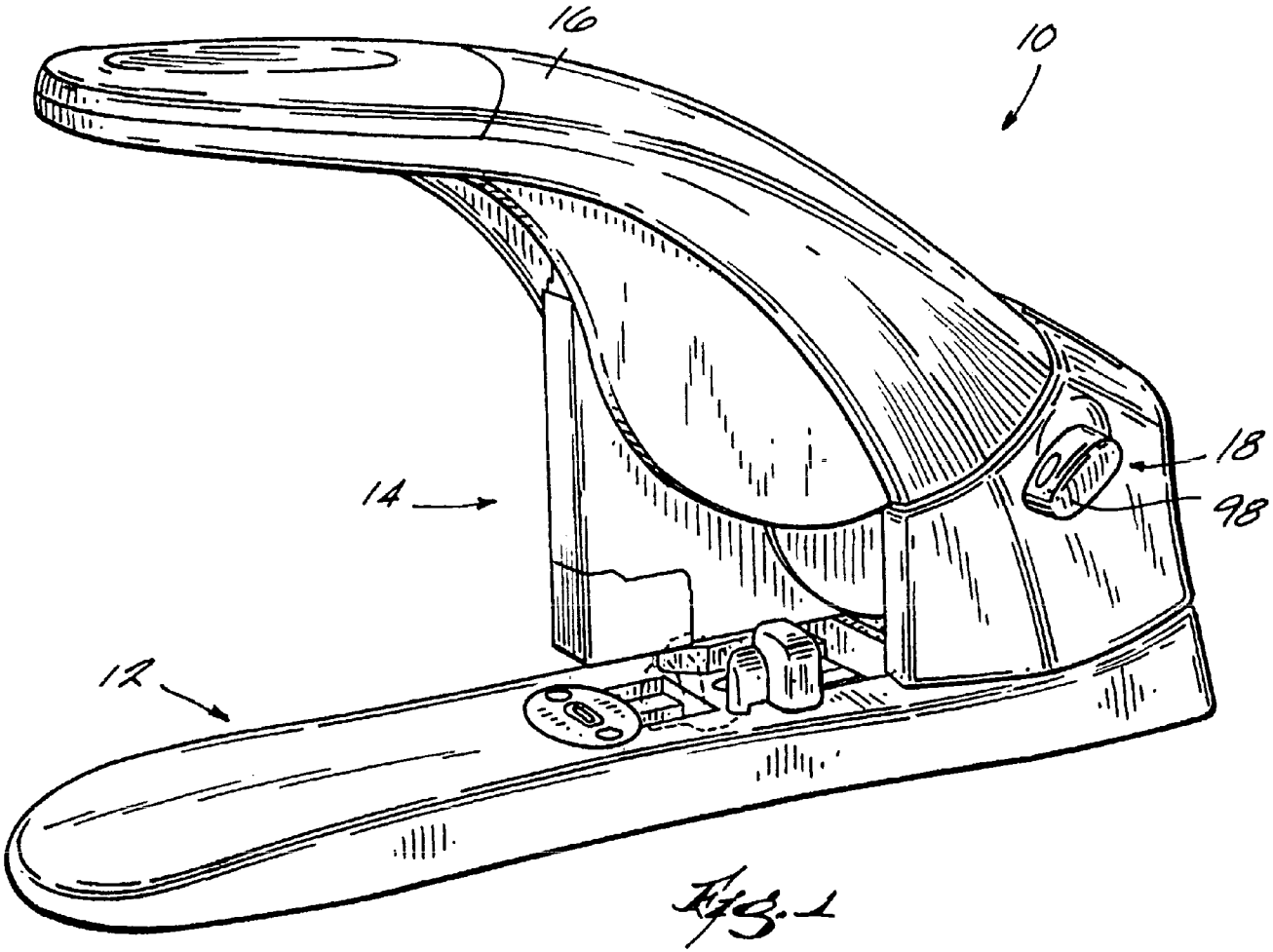
FIG. 1 is a perspective view of a heavy-duty stapler embodying the present invention.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items.

DETAILED DESCRIPTION OF THE PREFERRED EMBODIMENT

The illustrated heavy duty stapler 10 includes a base assembly 12, a cartridge assembly 14 pivotally mounted to the base assembly 12, a lever arm 16 pivotally mounted to the base assembly 12, and a jam clearing mechanism 18 that facilitates clearing of a jammed staple. The specifics of each of these assemblies are provided below.

Figure 2:
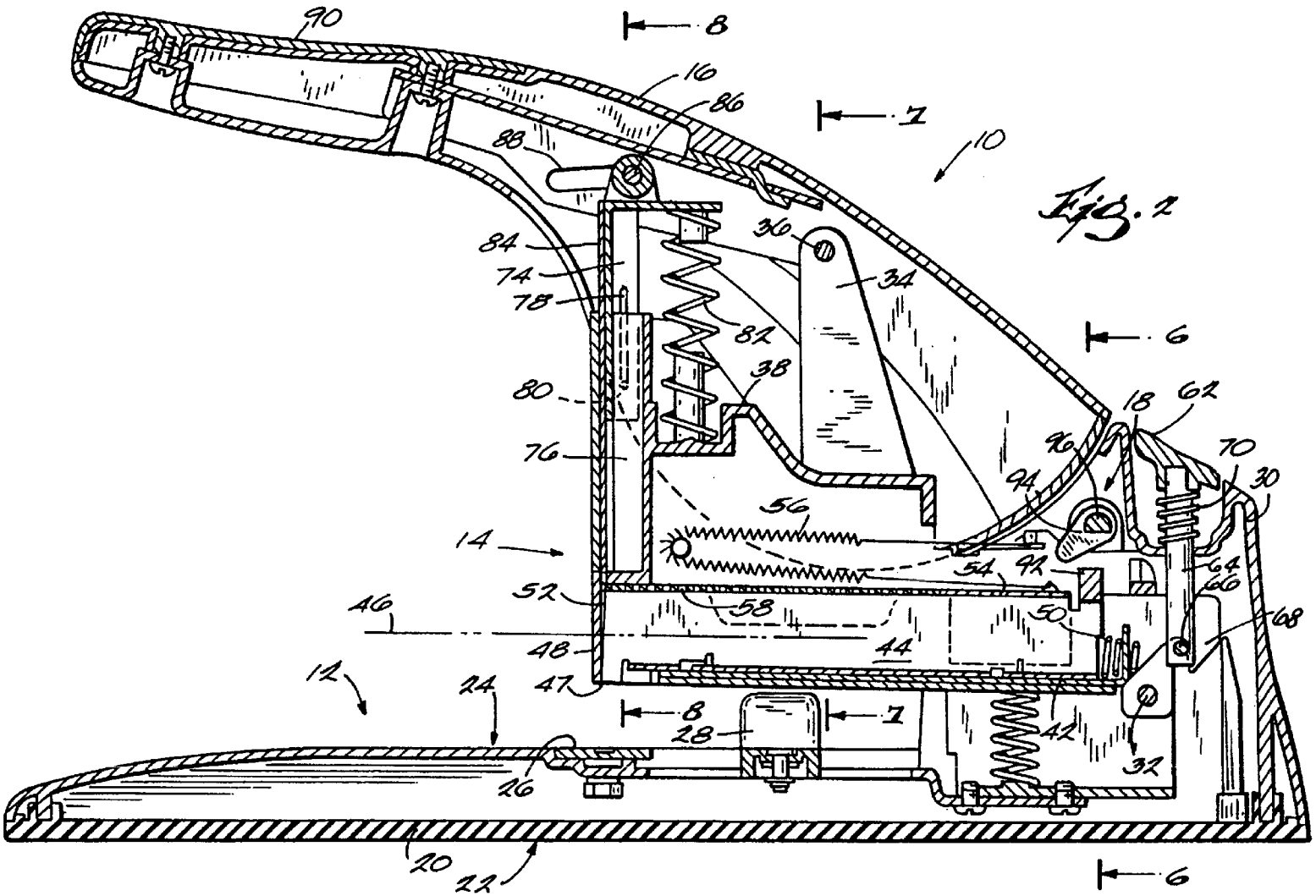
FIG. 2 is a side section view of the stapler shown in FIG. 1.
Figure 7:
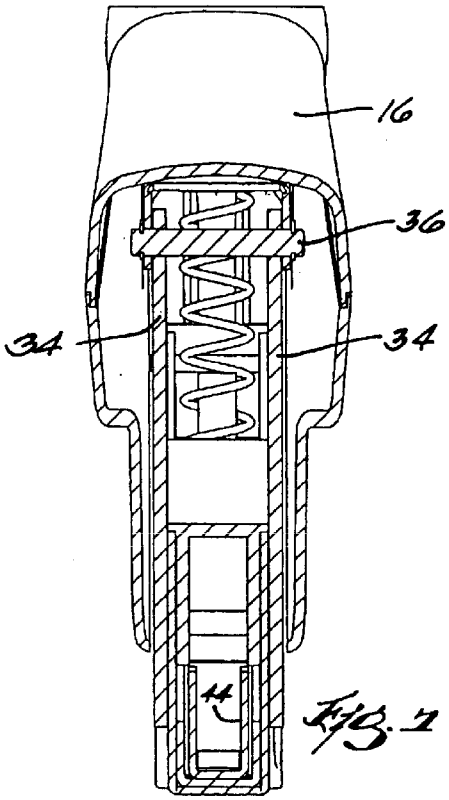
FIG. 7 is a section view taken along line 7—7 in FIG. 2.
Figure 6:
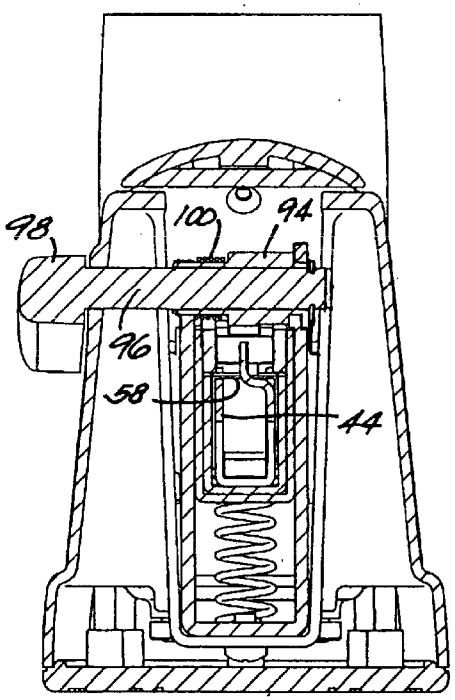
FIG. 6 is a section view taken along line 6—6 in FIG. 2.

The base assembly 12 includes a base 20 having a bottom surface 22 designed to rest upon a support surface, and a top surface 24 designed to support a stack of sheets during the stapling process. An anvil 26 is mounted to the top surface 24 and is designed to deform the ends of the staple under the stack of sheets. A paper guide 28 is mounted to the top surface 24 to facilitate positioning of the stack prior to the stapling process. The base assembly 12 further includes an upper housing 30 that supports a cartridge pivot rod 32 that pivotally connects the cartridge assembly 14 to the base assembly 12. The base assembly 12 further includes two laterally-opposed lever supports 34 (see FIGS. 2 and 7) that supports a lever pivot rod 36 that pivotally connects the lever arm 16 to the base assembly 12.

Figure 4:
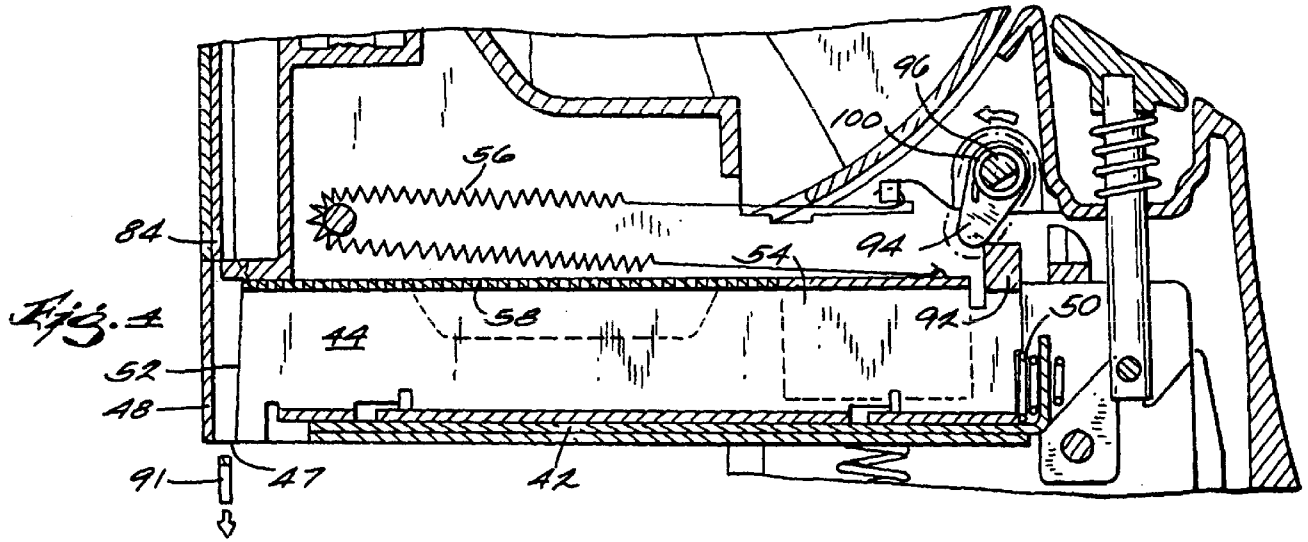
FIG. 4 is the section view of FIG. 3 with the jam clearing mechanism in the engaging position.

The cartridge assembly 14 includes a cartridge housing 38 that pivots on the cartridge pivot rod 32. A magazine is positioned in the cartridge housing 38 and is designed to feed staples for the stapling process. The magazine includes a magazine housing 42 and a rail 44 positioned in the magazine housing 42 for supporting staples along a longitudinal axis 46 (FIG. 2) defined by the magazine. The magazine housing 42 includes a dispensing opening 47 through which staples are forced during the stapling process. The rail 44 can move longitudinally relative to the magazine housing 42 from a static position adjacent a front wall 48 of the magazine housing 42 near the dispensing opening 47 (FIG. 2) to a retracted position away from the front wall (FIG. 4). A rail spring 50 biases the rail 44 relative to the magazine housing 42 and toward the static position. A front edge 52 of the rail 44 in angled to facilitate driving a staple into a stack of sheets, as described below in more detail. A pusher 54 is slidable on the rail 44, and a pusher spring 56 supplies a biasing force on the pusher 54 to keep the staples 58 constantly biased against the front wall 48 of the magazine housing 42.

Figure 3:
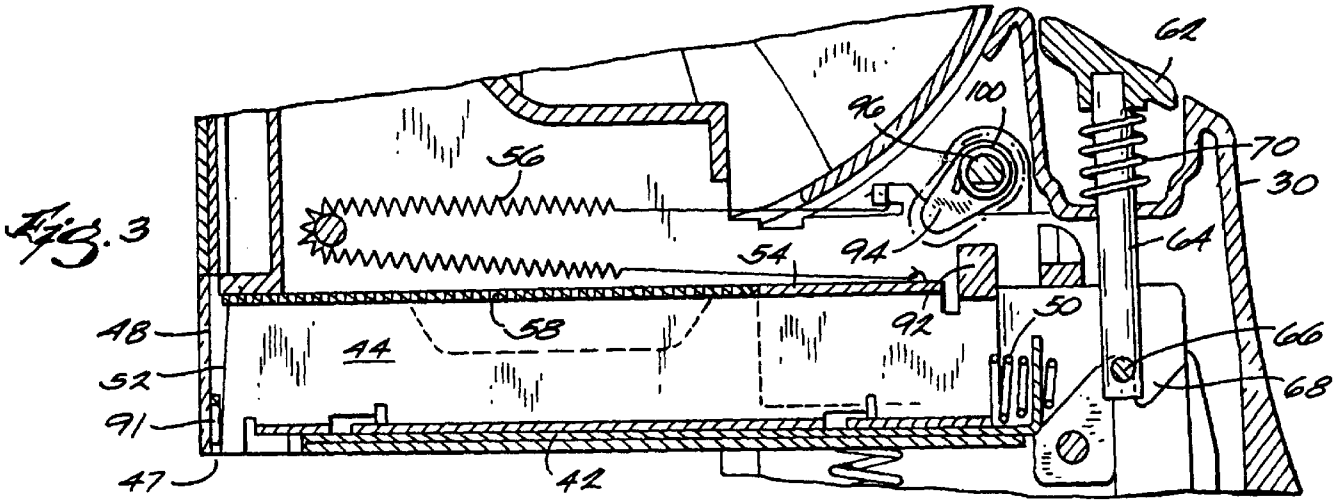
FIG. 3 is an enlarged side section view of the jam clearing mechanism in the static position.
Figure 5:
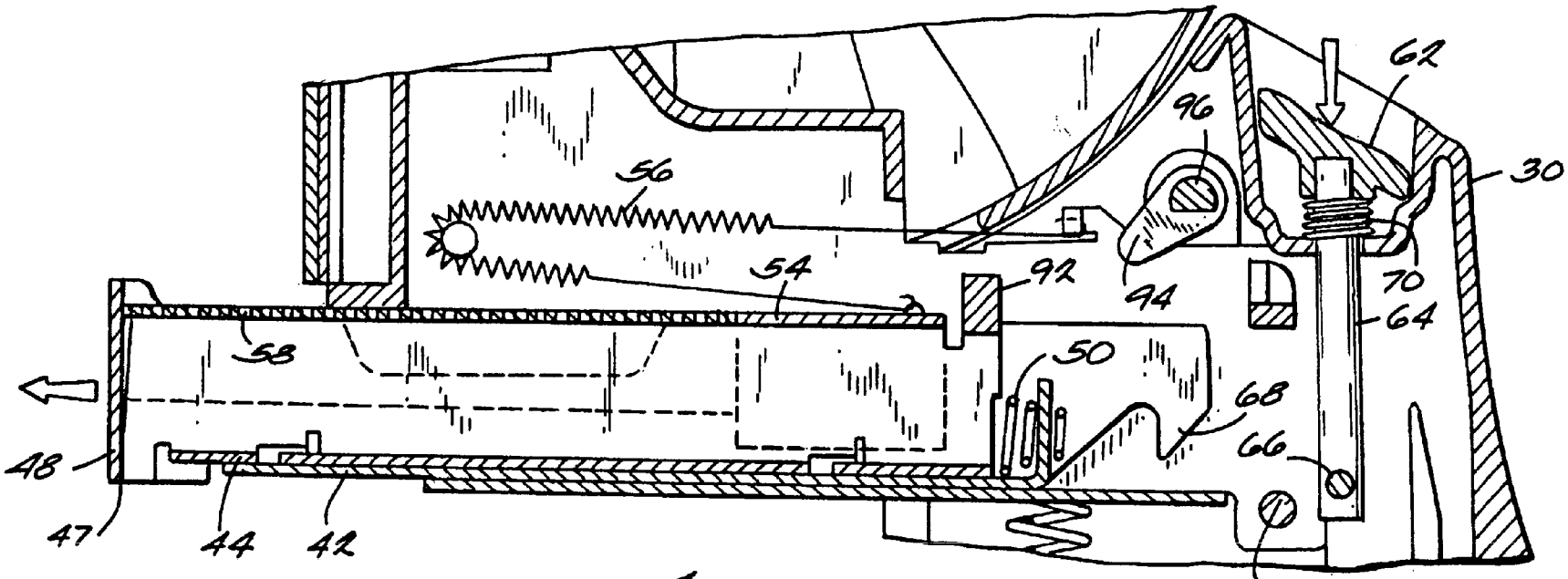
FIG. 5 is the section view of FIG. 3 with the magazine moving out of the cartridge housing without interference by the jam clearing mechanism 18.

The magazine is movable longitudinally relative to the cartridge housing 38 from a closed position (FIG. 3) to an open position (FIG. 5) to facilitate loading of staples 58 into the magazine. The magazine is biased toward the open position by the pusher spring 56, and can be held in the closed position by a magazine retainer. The magazine retainer includes a release button 62, a plunger 64 connected to the release button 62, a keeper 66 mounted to the plunger, and a latch 68 formed in the magazine housing 42. The keeper 66 is designed to engage the latch 68 to hold the magazine in the closed position (FIG. 3). The release button 62 can be pushed by the user to disengage the keeper 66 from the latch 68, thus allowing the magazine to move toward the open position under the biasing force of the pusher spring 56. The release button 62, plunger 64, and keeper 66 are biased upward by a release spring 70.

Figure 8:
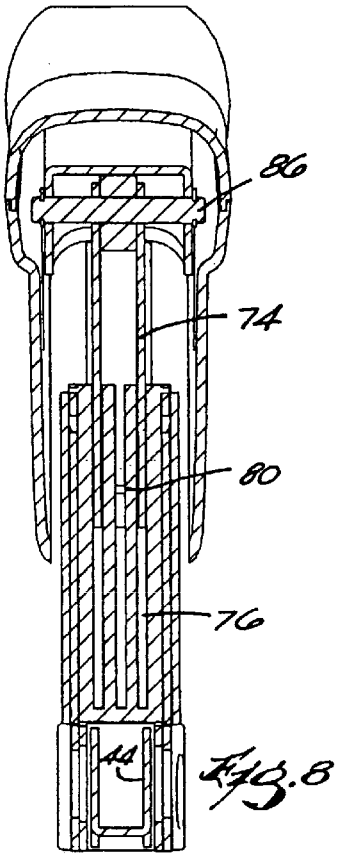
FIG. 8 is a section view taken along line 8—8 in FIG. 2.

Staples are pushed into a stack of sheets by a ram assembly (FIGS. 2 and 8) including a ram 74 designed to slide within a recess 76 in the cartridge housing 38. The ram 74 includes a slot 78 that interacts with a pin 80 in the cartridge housing 38 to limit the range of movement of the ram relative to the cartridge housing 38. The ram 74 is biased upward relative to the cartridge housing 38 by a ram spring 82. A driver blade 84 is connected to the ram 74 and is designed to transfer force from the ram 74 to the staple being driven into the stack. The upper end of the ram 74 is provided with a roller 86 that provides rolling interaction between the lever arm 16 and the ram 74. Alternatively, there could be sliding or other interaction between the lever arm 16 and the ram 74.

The lever arm 16 is pivotally coupled to the base 20 via the lever supports 34 and the lever pivot rod 36. The lever arm 16 includes a slot 88 that receives the roller 86 and provides a coupling between the lever arm 16 and the ram 74. The slot 88 facilitates relative movement between the lever arm 16 and the ram 74. A grip 90 provides a location for the user to apply a manual force for the stapling operation.

The jam clearing mechanism 18 is designed to provide a manual device that can move the rail 44 toward the retracted position to thereby increase the exit space between the front edge 52 of the rail 44 and the front wall 48. The goal is to allow the jammed staple 91 to fall out of the magazine by gravity. The jam clearing mechanism 18 includes a retractor adapted to engage the rail 44 and move the rail 44 toward the retracted position. In the illustrated embodiment, the retractor is designed to engage a tab 92 on the rail 44. More specifically, the retractor can be moved from a disengaged position out of engagement with tab 92 to an engaged position in engagement with tab 92. Further movement of the retractor will move the rail 44 away from the front wall 48 to achieve the desired result.

In the illustrated embodiment, the retractor is mounted to the base 20 and includes an actuator 94, a rotatable shaft 96 for rotatably supporting the actuator 94, and a handle 98 (FIG. 1) for manually rotating the actuator 94. The actuator 94 can be rotated from the disengaged position (FIG. 3) to the engaged position (FIG. 4) by rotating the handle 98. In the disengaged position, the actuator 94 is not aligned with the tab 92 in a direction parallel to the longitudinal axis 46. In the illustrated embodiment, the entire actuator 94 remains higher than the tab 92, thereby providing clearance between the tab 92 and the actuator 94 when the magazine is slid out of the cartridge housing 38. This feature facilitates removal of the magazine from the cartridge housing 38 for loading of staples. The retractor is biased toward the disengaged position by a torsion spring 100.

Various features of the invention are set forth in the following claims.

What is claimed is:

1. A stapler comprising:

a base; and a cartridge assembly coupled to the base, the cartridge assembly including a magazine having:

a magazine housing with a dispensing opening and defining a longitudinal axis, and a rail positioned in the magazine housing and movable relative to the housing along the longitudinal axis between a static position toward the opening and a retracted position away from the opening; and a rail retractor adapted to engage the rail and move the rail from the static position to the retracted position to facilitate removal of a jammed staple.

2. A stapler as claimed in claim 1, wherein the cartridge assembly includes a cartridge housing, and wherein the magazine is movable out of the cartridge housing to facilitate loading staples into magazine.

3. A stapler as claimed in claim 2, wherein the magazine is movable out of the cartridge housing in a direction parallel to the longitudinal axis.

4. A stapler as claimed in claim 1, wherein the rail includes a tab engageable by the retractor to facilitate movement of the rail by the retractor.

5. A stapler as claimed in claim 4, wherein the retractor is movable from a disengaged position out of engagement with the tab to an engaged position in engagement with tab.

6. A stapler as claimed in claim 5, wherein, in the engaged position the retractor is at least partially aligned with the tab in a direction parallel to the longitudinal axis, and in disengaged position the retractor is not aligned with the tab to facilitate movement of the magazine out of the housing for staple loading.

7. A stapler as claimed in claim 1, wherein the rail is biased toward the static position.

8. A stapler as claimed in claim 1, wherein the retractor is mounted to the base.

9. A stapler as claimed in claim 1, wherein the retractor is rotatable.

10. A stapler as claimed in claim 9, wherein the retractor includes a handle, a rotatable shaft coupled to the handle, and an actuator coupled to the shaft.

11. A method of removing a staple jammed in a stapler including a magazine housing having a front wall and a dispensing opening adjacent the front wall, and a rail positioned in the magazine housing and movable relative to the housing along a longitudinal axis between a static position toward the front wall and a retracted position away from the front wall, wherein the jammed staple is positioned between the rail and the front wall, the method comprising:

increasing a space between the rail and the front wall, wherein increasing the space includes moving the rail away from the front wall of the magazine housing.

12. A method as claimed in claim 11, wherein the stapler further includes a retractor adapted to engage the rail, and wherein moving includes engaging the retractor with the rail to move the rail from the static position to the retracted position.

13. A method as claimed in claim 12, wherein the rail includes a tab and moving includes moving the retractor from a disengaged position out of engagement with tab to an engaged position in engagement with tab.

14. A method as claimed in claim 13, wherein the engaged position corresponds with the retractor at least partially aligned with the tab in a direction parallel to the longitudinal axis, and wherein the disengaged position corresponds with the retractor not aligned with the tab to facilitate movement of the magazine out of housing for staple loading.

* * * * *